United States Patent [19]

Simmons et al.

[11] 4,316,166

[45] Feb. 16, 1982

[54] SELF-CONVERGING DEFLECTION YOKE AND WINDING METHOD AND APPARATUS THEREFOR

[75] Inventors: George A. Simmons; Kenneth W. McGlashan, both of Lancaster, Pa.

[73] Assignee: RCA Corporation, New York, N.Y.

[21] Appl. No.: 181,997

[22] Filed: Aug. 28, 1980

[51] Int. Cl.[3] ..... H01H 1/00

[52] U.S. Cl. ..... 335/213; 335/210

[58] Field of Search ..... 335/210, 212, 213

[56] References Cited

U.S. PATENT DOCUMENTS

| | | | |
|---|---|---|---|
| 4,023,129 | 5/1977 | Kratz et al. | 335/210 |
| 4,117,432 | 9/1978 | Shizu et al. | 335/210 |
| 4,128,824 | 12/1978 | Mirsch | 335/213 |
| 4,228,413 | 10/1980 | Campbell | 335/213 |

*Primary Examiner*—George Harris

*Attorney, Agent, or Firm*—E. M. Whitacre; P. J. Rasmussen; S. J. Stevens

[57] ABSTRACT

A self-converging deflection yoke for use with a color television kinescope provides both coma and side pincushion distortion correction through the use of double bias vertical deflection coils. The vertical coils are toroidally wound about a magnetically permeable core. A winding frame insert located within the interior of the core allows the coils to follow the desired double bias or diamond configuration. The core insert comprises a ring-shaped base adjacent to the core. Removable wire guide members are spaced away from the base to form channels between the guide members and the base. These channels receive the wires during windings and act to define the shape of the coils. After the coils are wound, the guide members are removed, allowing the yoke to be assembled.

3 Claims, 3 Drawing Figures

SELF-CONVERGING DEFLECTION YOKE AND WINDING METHOD AND APPARATUS THEREFOR

This invention relates to self-converging deflection yokes, and to a method and apparatus for winding a deflection coil having a double-bias configuration.

The majority of color television receivers on the market today include a picture tube having an electron gun assembly that produces three horizontally aligned electron beams. The in-line geometry of the electron beams allows a deflection yoke to be manufactured that substantially converges the electron beams at all locations on the picture tube screen without the need for dynamic convergence circuitry.

These self-converging yokes are constrained to have horizontal deflection coils that produce a negative isotropic astigmatism and vertical deflection coils that produce a positive isotropic astigmatism. The isotropic astigmatism provided by the deflection coils is determined by the nonuniformity, or $H_2$, function of the particular winding configuration of the deflection coils. It is known that positive isotropic astigmatism is provided by a deflection coil having a negative nonuniformity function, corresponding to a barrel-shaped deflection field, while negative isotropic astigmatism is provided by a deflection coil having a positive nonuniformity function corresponding to a pincushion-shaped field. Therefore, a self-converging yoke must have a vertical deflection coil having a net barrel-shaped deflection field and a horizontal coil having a net pincushion-shaped field.

Techniques for winding the deflection coils with configurations necessary to provide the desired nonuniformity functions are known, but yokes manufactured using these known techniques may cause vertical coma errors (i.e. the center beam raster is reduced in height with respect to the outer beam rasters) and side pincushion distortion.

Third order aberration theory can be used to explain the cause of the convergence errors and raster distortion exhibited by these self-converging yokes. It can be shown that coma errors of the type previously described are most sensitive to correction by a pincushion-shaped vertical deflection field near the entrance region of the yoke and side pincushion distortion may be corrected by a pincushion-shaped vertical deflection field near the exit end of the yoke. It is obvious that the field nonuniformity needed to correct vertical coma and side pincushion distortion is contrary to the nonuniformity required for self-convergence. A solution to this problem is to provide localized pincushion-shaped fields at the entrance and exit regions of the yoke, while still maintaining an overall net barrel-shaped deflection field.

One way to produce the necessary localized fields is through the use of external field formers mounted on or adjacent to the yoke. These field formers may be designed to distort the main deflection field into the desired shape or to channel external flux from the vertical coil to form a field having the desired shape. A copending U.S. Pat. Application, Ser. No. 164,344 filed June 30, 1980 in the name of McGlashan, discloses a unitary field former that provides pincushion-shaped fields at the entrance and exit ends of the yoke to correct coma and side pincushion distortion.

Another way to produce the required localized fields is through the configuration of the vertical deflection windings themselves. By winding the vertical coil so that the wires are concentrated near the yoke vertical axis a pincushion-shaped field is formed in the region of wire concentration. Conversely, concentrating the wire turns near the yoke horizontal axis will result in a barrel-shaped field in that region. Winding a vertical coil to produce pincushion-shaped fields at the ends of the yoke with a sufficient barrel-shaped field in the mid-yoke region to still provide an overall barrel field requires a double-bias winding technique, which presents difficulties in positioning and holding the wires in place. A ribbed or slotted ring located inside the core near the middle of the yoke has been used as a wire guide during winding. It has been found, however, that when the ribs are made of sufficient height to hold the wires properly during winding, the space occupied by the ring becomes significant, and it may become difficult or impossible to assemble the yoke with the desired spacing between the horizontal and vertical coils. It is, therefore, easier to manufacture a yoke having only a single bias winding therefore, eliminating the need for a wire guide ring in the interior of the core. Such a yoke may be made to correct either coma or side pincushion distortion. An external field former, such as those previously described, may then be used to correct the remaining errors or distortion.

Illustrative of the present invention is a method of winding a deflection yoke coil having a double bias configuration about a core. The method includes the steps of locating wire guides at the ends of the yoke and positioning a coil winding form within the interior of the core, with the form having a ring-shaped base, spacing members extending radially inwardly from the base, and removable guide members coupled to the spacing members. The guide members form a pair of circumferential channels between the guide members and the base. The coil winding method then comprises the step of winding the coil in a toroidal manner about the core such that each turn of the coil extends between the wire guides at the ends of the yoke and lies within one of the channels. The method is completed upon removing the removable guide members to allow assembly of the yoke.

The resultant self-converging yoke is used with a color television kinescope and comprises a pair of saddle-type horizontal deflection coils. A magnetically permeable annular core is disposed around the horizontal coils. Wire guides are located at each end of the core and a ring-shaped winding form having a plurality of inwardly directed projections is located adjacent to the interior surface of the core. Toroidally-wound vertical deflection coils are disposed about the core with the turns of the coils being captivated by the wire guides. Interior portions of the turns are disposed in a diamond configuration formed by respective wire paths extending from the ends of the core toward respective regions of the winding form. These regions are adjacent to respective ones of the projections, with the innermost of the turns lying closer to the longitudinal axis of the core than the projections.

In the accompanying drawing.

Figure 1:
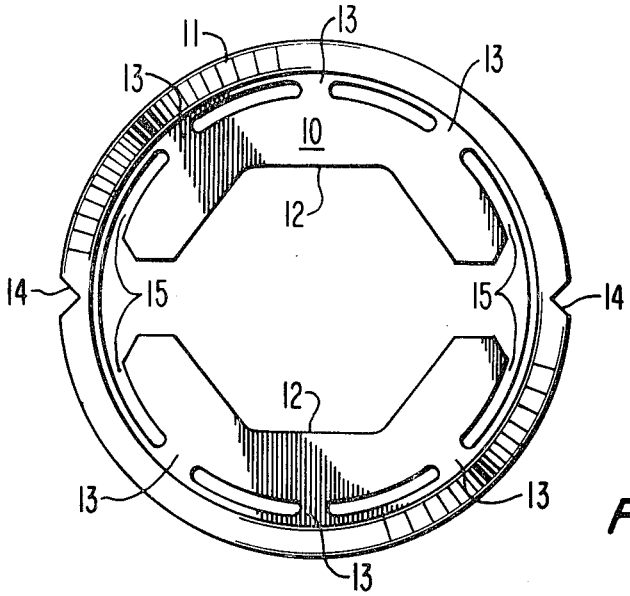
FIG. 1 is a top plan view of a deflection coil winding form in accordance with the present invention.
Figure 2:
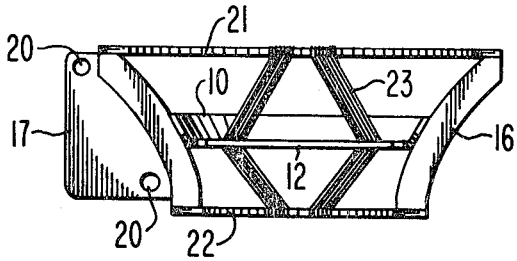
FIG. 2 is a side-elevational view of one half of a deflection yoke core showing one half of the winding form of FIG. 1 in place.

Referring to FIGS. 1 and 2 there is shown a deflection coil winding form 10, for use in the manufacture of a deflection yoke having saddle-type horizontal coils and toroidally-wound vertical coils, comprising an outer tapered ring 11 and two guide members 12. Guide members 12 are joined to ring 11 by spacers 13. Winding form 10 may be made of plastic or some other easily formed insulating material. Outer ring 11 also has two V-shaped grooves 14 formed or cut into it at diametrically opposed positions such that an imaginary line joining the two grooves 14 divides winding form 10 into two halves with one of the two guide members 12 located in each half.

FIG. 1 illustrates that guide members 12 are connected to ring 11 by three spacers 13. The number of spacers is not particularly important, although, as will be explained, the location of the outer spacers is critical. As can be seen in FIG. 1, a channel 15 is formed between each end of each guide member 12 and ring 11. The channels 15 receive the wires of the deflecting coil during winding.

During manufacture of the deflection yoke, and in particular, during winding of the vertical coils, the magnetically permeable ferrite core 16, shown in FIG. 2, is broken in two halves to facilitate winding of the coils. A plastic jughandle 17 incorporating holes 20 is attached to each half and provides a means of indexing the core half to the winding machine through holes 20. Wire guides 21 and 22 comprising semi-circular plastic pieces having slots or ribs are attached to each end of the core halves to provide a means of positioning the wires around the circumference of the core for proper distribution during winding.

FIG. 2 shows one half of the winding form 10 secured within the interior region of core 16. Winding form 10 is positioned so that grooves 14 are aligned with the cracks separating the halves of core 16. Form 10 may then be broken easily at grooves 14 so that one half of form 10 is positioned within each half of core 16. A portion of the vertical windings 23 are also shown in FIG. 2. Windings 23 have a diamond-shape or a double bias configuration. The wires are concentrated toward the core's vertical axis at both of its ends by the operation of wire guides 21 and 22 and toward the horizontal axis in the mid-core region by operation of channel 15, therefore forming a pincushion-shaped field at the ends and a barrel-shaped field in the mid-core region, as previously described. The winding distribution in the mid-core region is determined by the shape and dimensions of the channels 15. The width of the channel determines the number of layers of wire at a particular location. In a particular application the channel width and wire gauge were chosen to permit four layers of wire to lie within the channel. A tapered channel can be used to vary the number of wire layers throughout its distribution. The location of the outer spacers 13 along the core circumference determines the extent of bias of the windings, by determining the location of the wires with respect to the coils vertical and horizontal axes. The overall diameter of the winding form 10 will determine its vertical position in the interior region of the core and hence the point at which the direction of wire bias changes. Optimization of the diameter of form 10, the location of spacers 13 and the shape of channels 15 will allow a vertical coil 23 to be wound which is self-converging and exhibits substantially no vertical coma errors or side pincushion distortion. When the winding of vertical coil 23 is completed, guide members 12 may be removed by breaking form 10 at each of the spacers 13. The width of spacers 13 is made sufficiently small so that guide members 12 snap out easily. It may be desirable to bond the wire turns together prior to removing guide members 12 to prevent the wires from moving; an adhesive such as glue would be appropriate for this purpose. The part of form 10 that remains with the yoke, is thin enough so that it does not interfere with the remaining assembly of the yoke or cause difficulty in achievement of proper yoke positioning on the kinescope.

Figure 3:
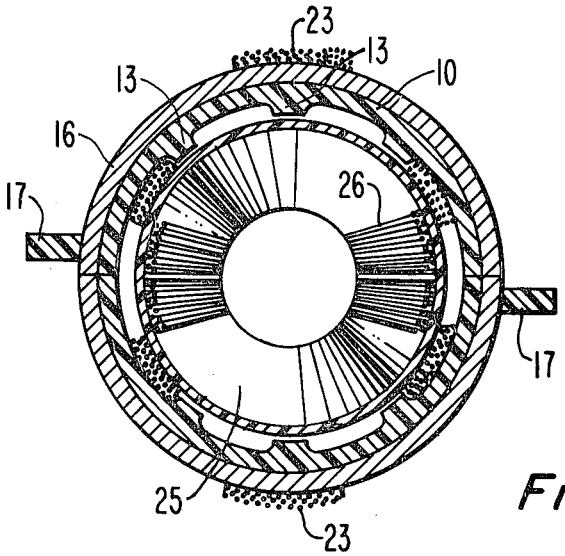
FIG. 3 is a top cross-sectional view of a yoke wound in accordance with this invention.

FIG. 3 illustrates a completed deflection yoke in cross-section, with guide members 12 removed. It can be seen that the insulator 25 separating the horizontal and vertical coils may be placed as close to the vertical coils as desired to in turn allow the vertical coils to be close to the tube. It can also be seen that the vertical windings extend beyond the end of the remaining parts of spacers 13, and remain in position without the need of wire guides. A portion of the horizontal saddle coils 26 and the return turns of the vertical coil 23 outside the core 16 can also be seen in FIG. 3. The use of winding form 10, therefore, permits the manufacture of self-converging deflection yokes having coma and side pincushion correction without the need for any external correctors or field formers.

What is claimed is:

1. A winding form for use in toroidally winding about a core a deflection coil having a double bias configuration, said form insertable into said core and comprising:

a ring-shaped base dimensioned to be positioned within the interior of said core;

a plurality of spacing members extending radially inward from said base; and a pair of removable guide members, coupled to said spacing members, each of said guide members forming a pair of circumferentially extending channels between said guide members and said base, said channels dimensioned to receive the wire turns of said toroidally-wound deflection coil, said guide members removable from said spacing members upon completion of the winding of said deflection coil.

2. A self-converging deflection yoke for use with a color television kinescope comprising:

a pair of saddle-type horizontal deflection coils;

a magnetically permeable annular core disposed about said horizontal coils;

wire guides disposed at the entrance and exit ends of said core;

a ring-shaped winding form member disposed adjacent to the interior surface of said core and having a plurality of inwardly directed projections; and vertical deflection coils comprising a plurality of wire turns, each of said turns being toroidally wound about said core and captivated by said wire guides, the interior portions of said turns disposed in a diamond configuration formed by respective wire paths extending from said entrance and exit ends toward respective regions of said form member adjacent to respective ones of said projections, with the innermost of said turns lying closer to the longitudinal axis of said core than said projections.

3. Method of winding a deflection coil of a deflection yoke about a magnetically permeable core, comprising the steps of:

locating wire guides at the entrance and exit ends of said core;

positioning within the interior of said core a coil winding form comprising a ring shaped base, a plurality of spacing members extending radially inward from said base and a pair of removable guide members coupled to said spacing members, with each of said guide members forming a pair of circumferentially extending channels between said guide member and said base;

winding said coil in a toroidal manner about said core such that each turn of said coil comprises a portion extending between said wire guides at said entrance and exit ends of said core and lying within a respective one of said channels; and removing said removable guide members to allow assembly of said yoke.

* * * * *